US006456244B1

(12) United States Patent
Goldstein et al.

(10) Patent No.: US 6,456,244 B1
(45) Date of Patent: Sep. 24, 2002

(54) PHASED ARRAY ANTENNA USING APERIODIC LATTICE FORMED OF APERIODIC SUBARRAY LATTICES

(75) Inventors: Mark L. Goldstein, Palm Bay, FL (US); Richard J. Nink, Melbourne, FL (US); Richard Phelan, Palm Bay, FL (US); David J. Tammen, Satellite Beach, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/911,350

(22) Filed: Jul. 23, 2001

(51) Int. Cl.[7] ..... H01Q 1/36; H01Q 21/00

(52) U.S. Cl. ..... 343/700 MS; 343/844; 343/853

(58) Field of Search ..... 343/700 MS, 792.5, 343/844, 853, 893, 895; 342/375; 455/562

(56) References Cited

U.S. PATENT DOCUMENTS

| | | | | | |
|---|---|---|---|---|---|
| 3,811,129 | A | * | 5/1974 | Holst | 342/371 |
| 4,052,723 | A | | 10/1977 | Miller | 343/100 |
| 4,465,373 | A | | 8/1984 | Tamaki et al. | 356/374 |
| 4,797,682 | A | * | 1/1989 | Klimczak | 343/770 |
| 5,262,790 | A | * | 11/1993 | Russo | 343/700 MS |
| 5,293,176 | A | | 3/1994 | Elliot | 343/797 |
| 5,294,939 | A | * | 3/1994 | Sanford et al. | 343/836 |
| 5,386,215 | A | | 1/1995 | Brown | 343/795 |
| 5,589,728 | A | | 12/1996 | Levine et al. | 313/336 |
| 5,600,342 | A | | 2/1997 | Pikulski et al. | 343/909 |
| 5,711,694 | A | | 1/1998 | Levine et al. | 445/24 |
| 5,808,784 | A | | 9/1998 | Ando et al. | 459/443 |
| 5,838,284 | A | * | 11/1998 | Dougherty | 343/700 MS |
| 5,955,994 | A | | 9/1999 | Staker et al. | 343/700 |
| 6,147,657 | A | * | 11/2000 | Hildebrand et al. | 343/844 |
| 6,175,671 | B1 | | 1/2001 | Roberts | 385/14 |
| 6,404,404 | B1 | * | 6/2002 | Chen et al. | 343/844 |

* cited by examiner

*Primary Examiner*—Tan Ho
(74) *Attorney, Agent, or Firm*—Allen, Dyer, Doppelt, Milbrath & Gilchrist, P.A.

(57) ABSTRACT

A phased array antenna (10) includes a plurality of subarray lattices (16) arranged in an aperiodic array lattice (14). Each subarray lattice (16) includes a plurality of antenna elements (20) arranged in an aperiodic configuration such as formed on a multilayer circuit board (24). Electronic circuitry (26) are supported by the circuit board and mounted between the antenna elements (20) and operatively connected thereto for amplifying, phase shifting and beam forming any transmitted or received signals.

29 Claims, 6 Drawing Sheets

| | | | |
|---|---|---|---|
| 1. tilt≡ 15·deg | $\theta_0$ ≡-15·deg | $\phi_0$ ≡ 45·deg | $\theta_{BS}(\theta_0,\phi_0)$= 53.6deg PANEL TILT ANGLE, BEAM STEERING ANGLES, & RESULTING BORESIGHT SCAN ANGLE |
| 2. | cosexp≡1 | taper≡-2.1 | COSINE ARRAY TAPER (COSEXP=COS EXPONENT, TAPER IN dB, e.g. -10 dB) |
| 3. nbits≡4 | MagErr≡1 | PhaseErr≡10·deg | # OF PHASE SHIFTER BITS & RANDOM MAGNITUDE (dB) & PHASE ERRORS FOR WEIGHTS |
| 4. MBG=38.9 | $BW_{el}$=1.5deg | $BW_{az}$=1.9deg | MAIN BEAM GAIN (dBiC) & BEAMWIDTHS (NULL-TO-NULL) |

*FIG. 4A.*

PHASED ARRAY ANTENNA USING APERIODIC LATTICE FORMED OF APERIODIC SUBARRAY LATTICES

FIELD OF THE INVENTION

This invention relates to the field of phased array antennae, and more particularly, this invention relates to phased array antennae using an array lattice formed from a plurality of subarray lattices.

BACKGROUND OF THE INVENTION

Low cost phased arrays are required on naval ships, land based radar stations and similar areas. Traditional phased arrays using periodic lattices and transmit/receive modules are prohibitive in cost. When the antenna are designed for use with short wavelengths, the transmit/receive modules are bulky and cannot be positioned between antenna elements. Also, advanced radar designs require low side lobe architecture. Also, many subarrays are desired.

One prior art approach uses a traditional periodic array orientation of subarrays. It has been found that this type of prior art phased array antenna produces grating lobes. This is found especially true at higher frequency applications, such as the X-band and KU-band. Even lower frequency applications than the UHF, L-band and S-band have been found to produce grating lobes.

It would also be advantageous if any phased array antenna at these higher applications that are formed from different array lattices of subarray lattices could use a low cost circuit board in lieu of individual modules with lower cost antenna elements. Antenna elements possibly could be printed radiating elements or surface mounted components. Not only could ship board phased arrays be used, but also space-based systems, ground-based SATCOM nodes, cell towers and wireless internet could be applicable and used with an improved phased array antenna.

Some prior art proposals have used different antenna designs, such as U.S. Pat. No. 4,052,723 that shows a randomly agglomerated subarray for phased array radars. This has not been found advantageous.

SUMMARY OF THE INVENTION

The present invention advantageously provides a phased array antenna having a plurality of subarray lattices arranged in an aperiodic array lattice. Each subarray lattice comprises a plurality of antenna elements arranged in an aperiodic configuration such that any transmitted or received signals have reduced side lobes. In one aspect of the invention, each subarray lattice includes a circuit board and a plurality of antenna elements arranged in an aperiodic configuration on the circuit board. Electronic circuitry is supported by the circuit board and operatively connected to the antenna elements for amplifying, phase shifting and beam forming any transmitted or received signals with reduced side lobes. Because of the aperiodic configuration, the electronic circuitry can be mounted between antenna elements. An antenna support member can support each circuit board and the plurality of subarray lattices as an aperiodic array lattice.

In yet another aspect of the present invention, each antenna element is arranged in an aperiodic configuration and spaced from each other a distance greater than one-half wavelength of a transmitted or received signal. The plurality of subarray lattices that form the aperiodic array lattice are formed as concentric circles in an aperiodic configuration. The antenna elements of each subarray lattice are configured in a spiral. Each subarray lattice is substantially identical to each other. The number of subarray lattices arranged in the aperiodic array are the same as the number of antenna elements forming each subarray lattice. The antenna elements can comprise surface mounted antenna elements or printed antenna elements.

In yet another aspect of the present invention, the circuit board is formed as a multilayer circuit board with amplifiers, phase shifters, beam forming networks, and central networks distributed among the layers. The multilayer circuit board can be formed of green tape in yet another aspect of the present invention.

BRIEF DESCRIPTION OF THE DRAWINGS

Other objects, features and advantages of the present invention will become apparent from the detailed description of the invention which follows, when considered in light of the accompanying drawings in which:

FIG. 4A is a chart showing variables of the aperiodic array lattice with comments explaining the variables.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The present invention is advantageous and overcomes the prior art drawbacks using traditional periodic array lattices formed of various subarrays that produce grating lobes. The present invention advantageously uses a low-cost approach having an aperiodic array lattice of identical subarray lattices to form a phased array antenna structure. The traditional transmit/receive "module" approach is not used as being too costly. The present invention can be used at higher frequency applications, such as X-band and KU-band and lower frequency applications, including UHF, L-band and S-band applications. The present invention advantageously uses a low cost circuit board in lieu of transmit/receive modules and can use printed radiating elements and/or surface mount components. It can be formed as an array where the aperiodic array lattice is formed of aperiodic subarray lattices.

Figure 1:
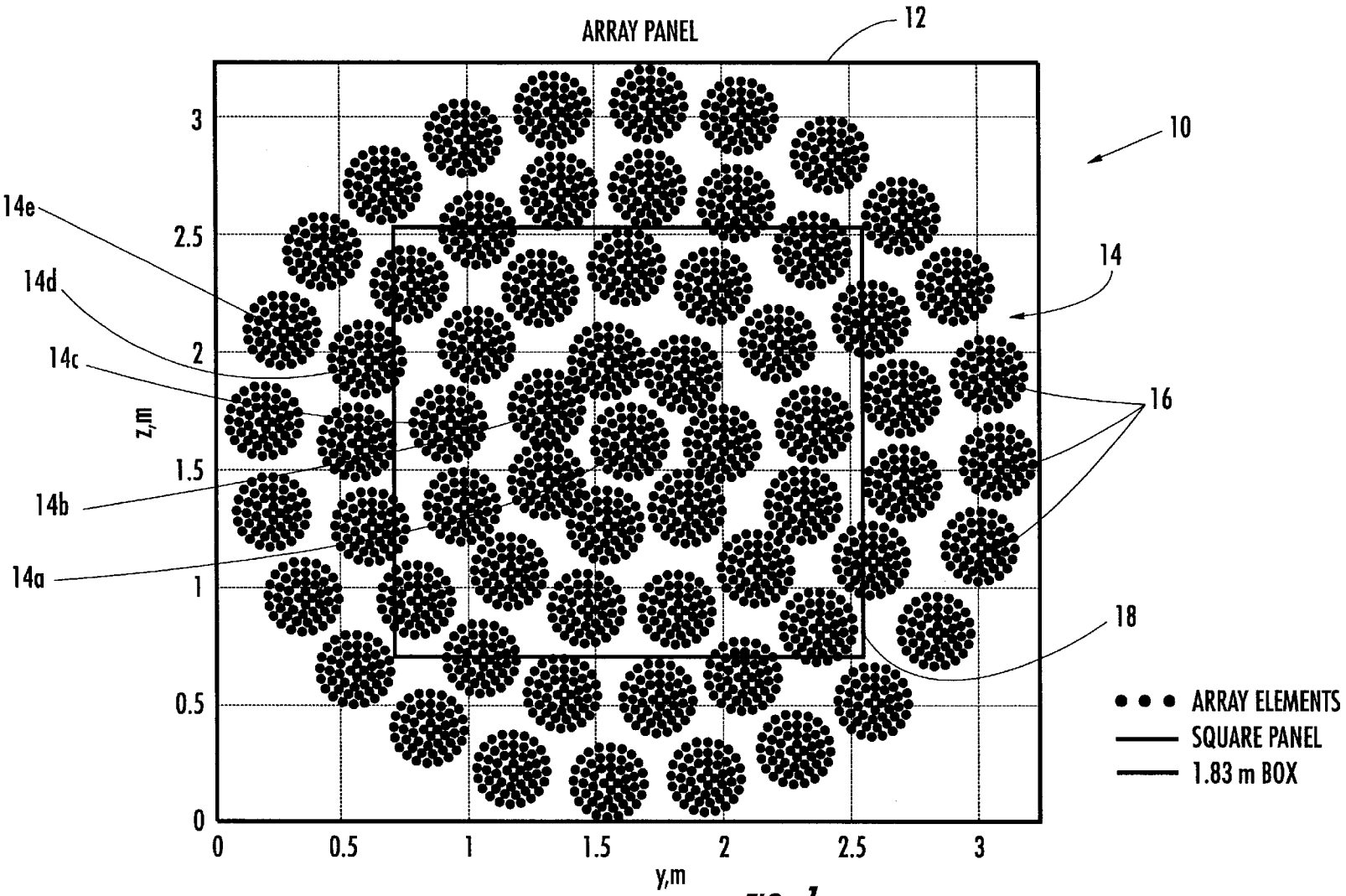
FIG. 1 is a plan view of a phased array antenna formed as an aperiodic array panel of the present invention and showing a plurality of aperiodic subarray lattices positioned in aperiodic configuration to form the aperiodic array panel.

FIG. 1 illustrates a phased array antenna 10 of the present invention and showing in greater detail an array panel 12 having the aperiodic array lattice 14 that is formed from preferably identical aperiodic subarray lattices 16 of the present invention. The entire array panel 12 is also referred to as a super lattice because it is formed from the aperiodic subarray lattices 16 shown in FIG. 2. The array panel 12 can be formed as a square panel box or other support structure and deployed on a structure for ship board and other use. The super lattice can be formed with subarray lattices 16 or another super lattice will also work as shown by the interior square box 18, where a smaller number of subarray lattices 16 are illustrated. Although certain dimensions are shown relative to a specific illustrated example, the present invention is not limited to such dimensions, but are only representative of one phased array antenna structure as a non-limiting example.

This aperiodic configuration shown in FIG. 1 has a center aperiodic subarray 14*a*, surrounded by a first ring 14*b* of closely spaced and circumferentially extending plurality of subarrays, showing seven subarrays contiguous to each other, and surrounded by three other concentric rings 14*c*, 14*d* and 14*e* in an aperiodic configuration. The second ring 14*c* includes 13 subarrays and the third concentric ring 14*d* includes 19 subarrays. The fourth outer ring 14*e* includes 24 subarrays, thus making a total of 64 subarrays to form the super lattice. It has been found that this aperiodic super lattice formed of the identical aperiodic subarray lattices reduces grating lobes to an acceptable level.

Figure 3:
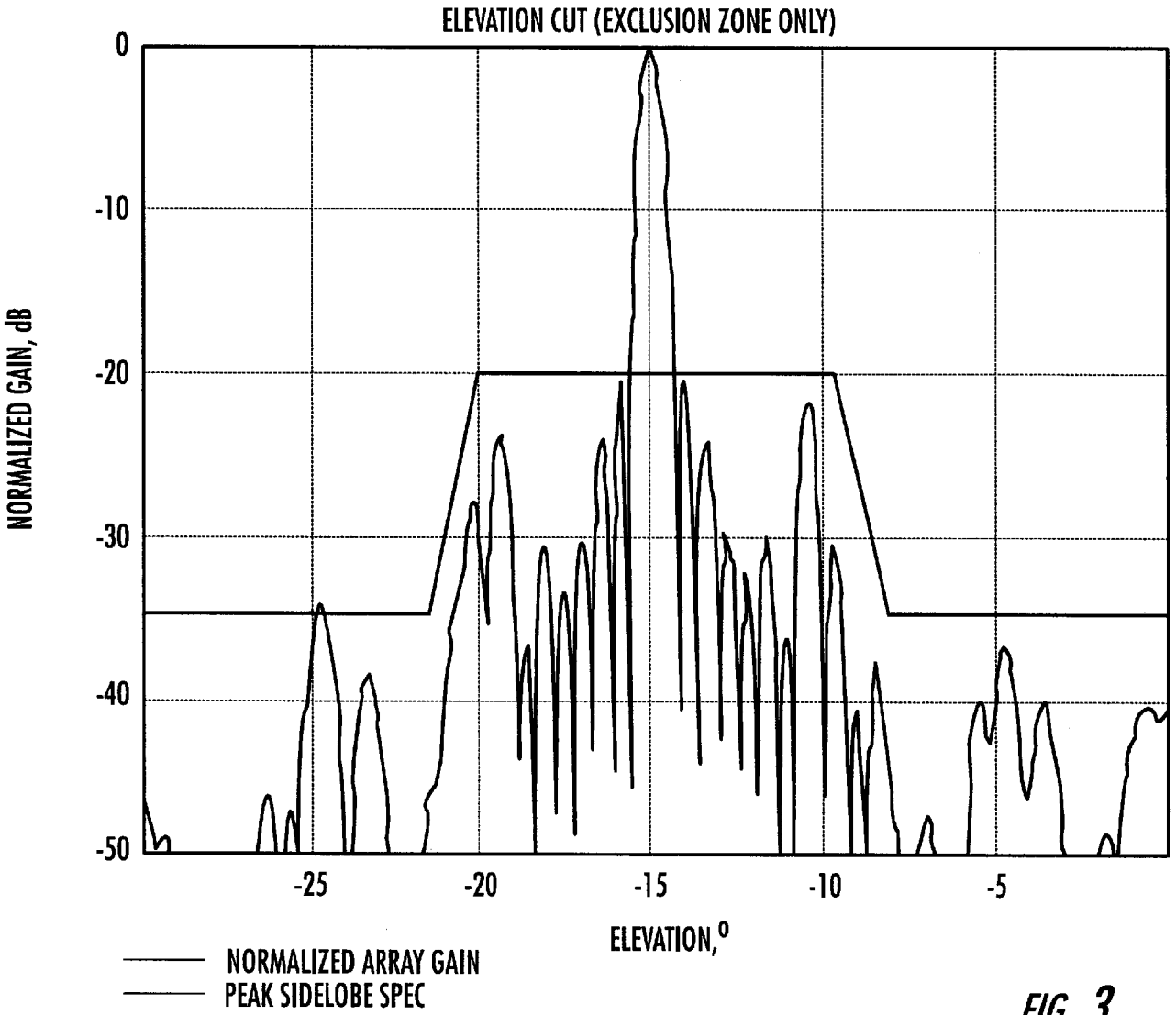
FIG. 3 is a graph showing normalized gain versus elevation for an elevation cut of the aperiodic array panel shown in FIG. 1.
Figure 4:
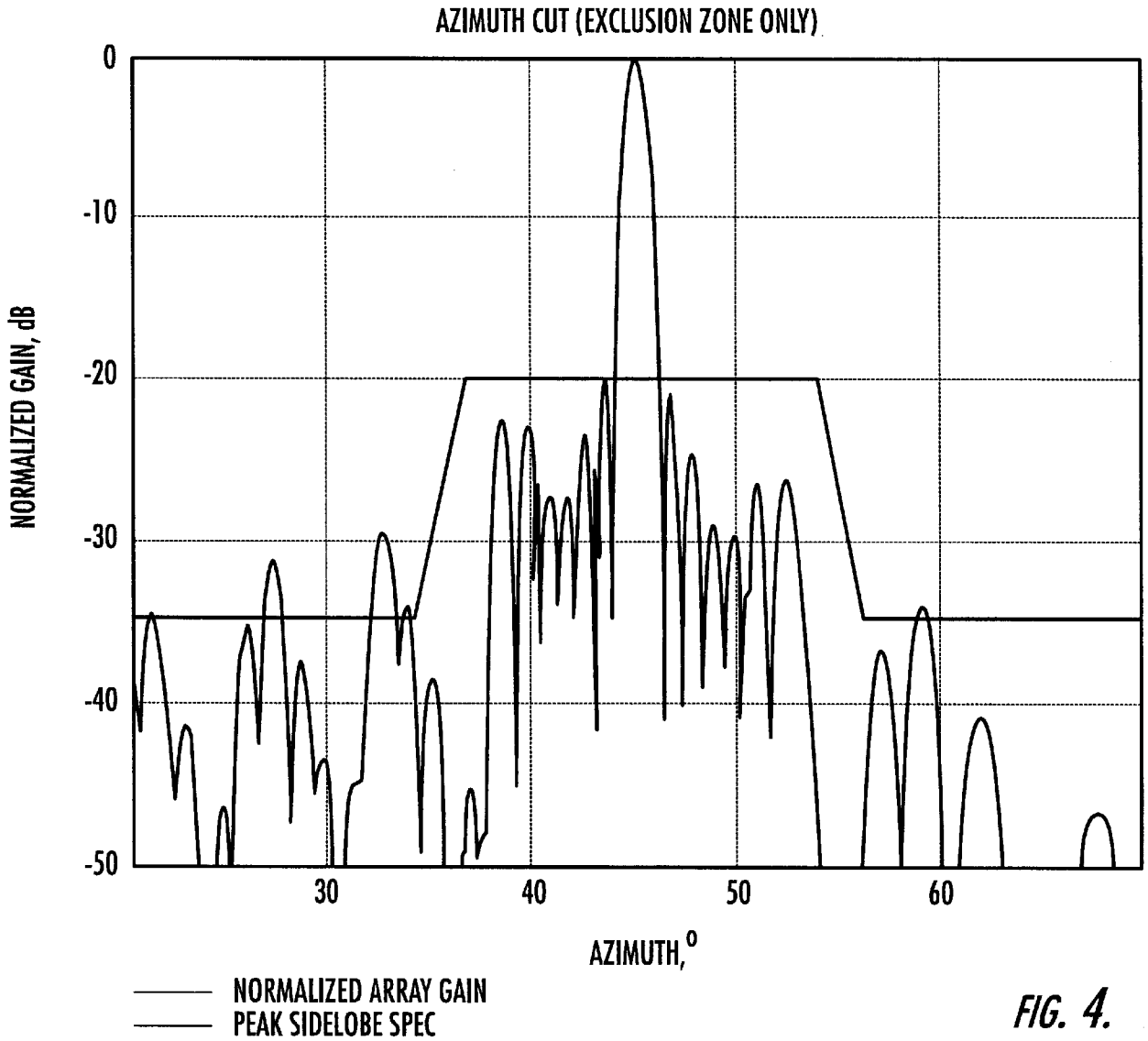
FIG. 4 is a graph showing normalized gain versus azimuth for an azimuth cut of the aperiodic array panel shown in FIG. 1.

For the array lattice 14 shown in FIG. 1, various frequencies can be used. This illustrative example has been found to have a normalized gain in decibels as shown by an elevation cut for the exclusion zone only in FIG. 3 and a normalized gain in decibels as shown along an azimuth cut for the exclusion zone only in FIG. 4. Representative numerical operating and performance figures and values for the array panel 12 shown in FIG. 1 having the aperiodic subarray lattices are as follows:

f=14.615 GHz $D_{max}$=1.83 m N=64 NN=64
frequency (Ku=14.615, X=10.3), max diameter, # of elements/subarrays, & # of subarrays (Ku=64, X=40)

FIG. 4A illustrates a chart of the various phased array antenna values with an explanation that can be used with the present invention. For example, as a non-limiting example, line 1 is an example of values for the panel tilt angle, beam steering angles and resulting bore site scan angle. Line 2 are values as non-limiting examples of the cosine array taper. Line 3 are representative values of the number of phase shifter bits and random magnitude (dB) and phase errors for weights. Line 4 are examples of a main beam gain (dBiC) and beam widths (null-to-null).

Figure 2:
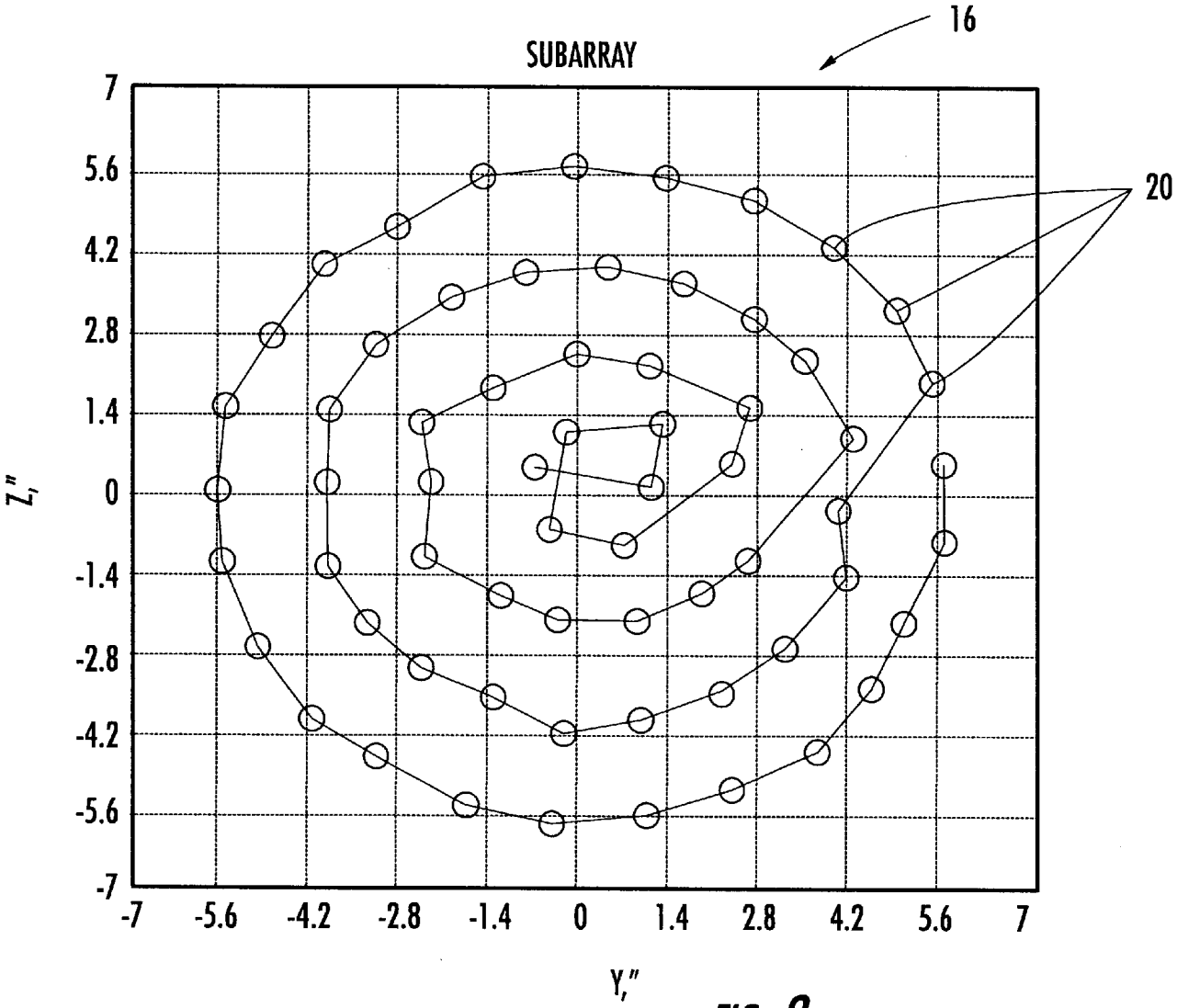
FIG. 2 is a plan view of an aperiodic subarray lattice of the present invention.

The subarray lattice 16 is shown in FIG. 2 and illustrates an aperiodic array of 64 antenna elements 20 arranged in a spiral configuration. The antenna elements 20 can be selected from known types of antenna elements as known to those skilled in the art, and arranged on a structure as described below. They can be printed or surface mounted. The subarray lattice 16 as illustrated has various operating characteristics, and in the illustrated example, the operating characteristics are as follows:

| | |
|---|---|
| $G_{subarray}$ = 24.6 | maximum possible subarray gain (dBiC) |
| D = 8.695 in | subarray aperture size with panel edge |
| N•NN = 4096 | total # of antennas |

-continued

| | |
|---|---|
| $G_{array}$ = 42.7 | maximum possible array gain (dBiC) |
| DD = 2.274 m | array panel aperture size |

Although the spiral configuration as illustrated is only one type of aperiodic configuration, it has been found adequate such that when a plurality of subarray lattices 16 are configured in the aperiodic configuration for the array panel 12 of the array super lattice 14 as shown in FIG. 1, the grating or side lobes are reduced adequately, such that the side lobes are significantly reduced to levels acceptable for SATCOM certification. The spacing of antenna elements 20 also is such that there is room for amplifiers and phase shifters between antenna elements. This is advantageous and the aperiodic spacing is required when spacing is greater than one-half wavelength. Any shorter spacing would create a situation where there is no room to place the LNA's (Low Noise Amplifiers), phase shifters, beam forming network circuit, and other circuit elements, as known to those skilled in the art. This type of configuration forms an adequate aperture for efficiency in operation.

Figure 5:
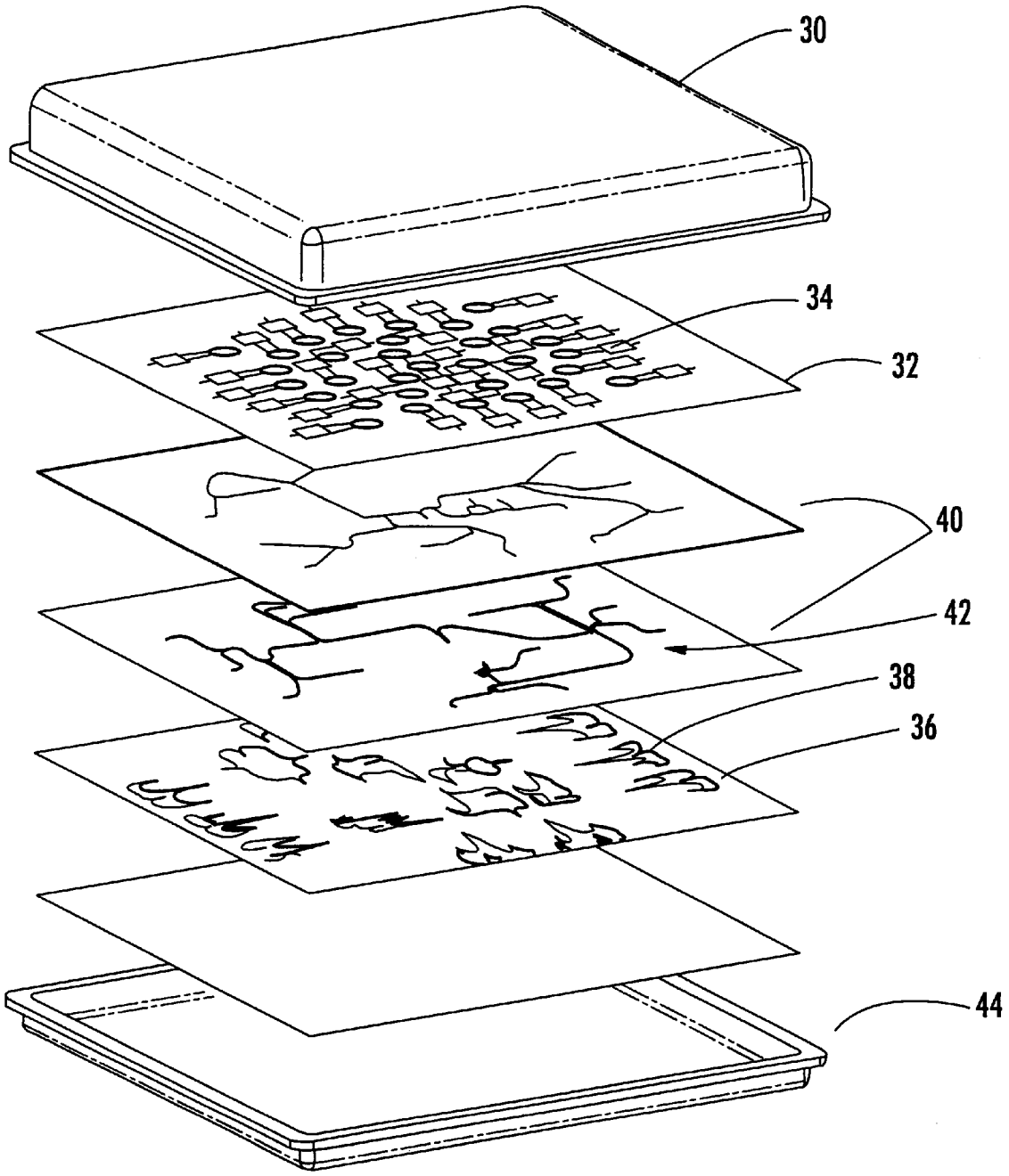
FIG. 5 is an exploded isometric view of the aperiodic subarray lattice of the present invention and formed from a single multi-layer PWB and showing layers for supporting amplifier elements, beam former network, phase shifters and packaging components.

Referring now to FIG. 5, there is shown a representative subarray lattice 16 in a low-cost phased array architecture. When used with the array panel configuration shown in FIG. 1, production cost is reduced. The multi-layer printed circuit board 24 can include surface mount components, as is known to those skilled in the art. This architecture is scalable to higher and lower frequency bands.

A subarray lattice 16 structure is shown in FIG. 5, and includes a radome 30 and the radiating elements 20 positioned on one multilayer board 24. A top layer 32 of the board can include, for instance, amplifier elements 34, including low noise amplifiers (LNA) or other components and a bottom layer 36 portion of the board can include, for instance, phase shifters, post amplification circuit elements with combiners and beam steering elements 38 or other components. A middle layer 40 portion (such as two layers) can include a beam former network 42 with power combing and signal distribution. Other layers can include beam control components filtering or other components, which can exist combined on some layers or separate. The layers can be formed by techniques known to those skilled in the art, including green tape layers. Mechanical packaging components 44 include basic power supplies, cooling circuits and packaging. Such a structure can then be placed in another support structure and form part of the lattice as a microstrip patch element.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. A phased array antenna comprising:

a plurality of subarray lattices arranged in an aperiodic array lattice, each subarray lattice comprising a circuit board, a plurality of antenna elements arranged in an aperiodic configuration on said circuit board; and electronic circuitry supported by said circuit board and operatively connected to said antenna elements for amplifying, phase shifting and beam forming any transmitted or received signals with reduced side lobes and grating lobes.

2. A phased array antenna according to claim 1, and further comprising an antenna support member that supports each circuit board and said plurality of subarray lattices as an aperiodic array lattice.

3. A phased array antenna according to claim 1, wherein each antenna element arranged in an aperiodic configuration is spaced from each other a distance greater than one-half wavelength of a transmitted or received signal.

4. A phased array antenna according to claim 1, wherein said plurality of subarray lattices that form the aperiodic array lattice are formed as concentric circles in an aperiodic configuration.

5. A phased array antenna according to claim 1, wherein said antenna elements of each subarray lattice are configured in a spiral.

6. A phased array antenna according to claim 1, wherein each subarray lattice is substantially identical to each other.

7. A phased array antenna according to claim 1, wherein the number of subarray lattices arranged in the aperiodic array is substantially the same as the number of antenna elements forming each subarray lattice.

8. A phased array antenna according to claim 1, wherein said antenna elements comprise surface mounted antenna elements.

9. A phased array antenna according to claim 1, wherein said antenna elements comprise printed antenna elements.

10. A phased array antenna comprising:

a plurality of subarray lattices arranged in an aperiodic array lattice, each subarray lattice comprising a multi-layer circuit board, a plurality of antenna elements arranged in an aperiodic configuration on said multilayer circuit board; and electronic circuitry supported by said circuit board and operatively connected to aid antenna elements for amplifying, phase shifting and beam forming any transmitted or received signals with reduced side lobes and grating lobes.

11. A phased array antenna according to claim 10, wherein electronic circuitry is mounted between said antenna elements.

12. A phased array antenna according to claim 10, and further comprising an antenna support member that supports each circuit board and said plurality of subarray lattices as an aperiodic array lattice.

13. A phased array antenna according to claim 10, wherein said multilayer circuit board is formed of green tape.

14. A phased array antenna according to claim 10, wherein each antenna element arranged in an aperiodic configuration is spaced from each other a distance greater than one-half wavelength of a transmitted or received signal.

15. A phased array antenna according to claim 10, wherein said plurality of subarray lattices that form the aperiodic array lattice are formed as concentric circles in an aperiodic configuration.

16. A phased array antenna according to claim 10, wherein said antenna elements of each subarray lattice are configured in a spiral.

17. A phased array antenna according to claim 10, wherein each subarray lattice is identical to each other.

18. A phased array antenna according to claim 10, wherein the number of subarray lattices arranged in the aperiodic array is substantially the same as the number of antenna elements forming each subarray lattice.

19. A phased array antenna according to claim 10, wherein said antenna elements comprise surface mounted antenna elements.

20. A phased array antenna according to claim 10, wherein said antenna elements comprise printed antenna elements.

21. A phased array antenna comprising:

a plurality of subarray lattices arranged in an aperiodic array lattice, each subarray lattice comprising a plurality of antenna elements arranged in an aperiodic configuration such that any transmitted or received signals have reduced side lobes and grating lobes.

22. A phased array antenna according to claim 21, and further comprising a circuit board on which each plurality of antenna elements forming a subarray lattice are mounted.

23. A phased array antenna according to claim 22, and further comprising an antenna support member that supports said circuit board.

24. A phased array antenna according to claim 21, and further comprising an antenna support member that supports said plurality of subarray lattices as an aperiodic array lattice.

25. A phased array antenna according to claim 21, wherein each antenna element arranged in an aperiodic configuration is spaced from each other a distance greater than one-half wavelength of a transmitted or received signal.

26. A phased array antenna according to claim 21, wherein said plurality of subarray lattices that form the aperiodic array lattice are formed as concentric circles in an aperiodic configuration.

27. A phased array antenna according to claim 21, wherein said antenna elements of each subarray lattice are configured in a spiral.

28. A phased array antenna according to claim 21, wherein each subarray lattice is identical to each other.

29. A phased array antenna according to claim 21, wherein the number of subarray lattices arranged in the aperiodic array is substantially the same as the number of antenna elements forming each subarray lattice.

* * * * *